United States Patent [19]

Christian et al.

[11] 4,132,660

[45] Jan. 2, 1979

[54] GREASE COMPOSITIONS

[75] Inventors: John B. Christian, Yellow Springs; Christ Tamborski, Dayton, both of Ohio

[73] Assignee: The United States of America as represented by the Secretary of the Air Force, Washington, D.C.

[21] Appl. No.: 882,527

[22] Filed: Mar. 1, 1978

[51] Int. Cl.[2] ..... C10M 1/32; C10M 3/26; C10M 5/20; C10M 7/30

[52] U.S. Cl. ..... 252/51.5 R; 252/52 A; 252/392

[58] Field of Search ..... 252/51.5 R, 52 A, 392

[56] References Cited

U.S. PATENT DOCUMENTS

| | | | |
|---|---|---|---|
| 3,525,690 | 8/1970 | Christian | 252/51.5 R |
| 4,071,459 | 1/1978 | Cohen et al. | 252/51.5 R |

*Primary Examiner*—Irving Vaughn

*Attorney, Agent, or Firm*—Joseph E. Rusz; Cedric H. Kuhn

[57] ABSTRACT

An antirust, anticorrosion grease composition comprising a major proportion of a perfluorinated polyalkylether base fluid, a minor proportion of a fluorocarbon polymer thickening agent, and a rust and corrosion inhibiting amount of a fluorine-containing benzoxazole.

12 Claims, No Drawings

GREASE COMPOSITIONS

RIGHTS OF THE GOVERNMENT

The invention described herein may be manufactured and used by or for the Government of the United States and all governmental purposes without the payment of any royalty.

FIELD OF THE INVENTION

This invention relates to grease compositions containing additives which inhibit rust and corrosion in high humidity and high temperature environments.

BACKGROUND OF THE INVENTION

Primarily because of their thermal stability, it has been recognized that perfluorinated polyalkylether fluids possess a great potential for use as lubricants. For example, the prior art discloses greases formulated from these fluids and thickeners such as a fluorinated copolymer of ethylene and propylene or a polymer of tetrafluoroethylene. These greases have proven to be useful as lubricants over a wide range of temperatures, e.g., as low as −40° F. and as high as 600° F. While the greases have been found to possess superior lubricating characteristics, their utility has been limited by their inability to provide rust preventive properties when used as a lubricant for ferrous metals under conditions of high humidity and mild temperatures (below 212° F.). Their utility has also been limited by their inability to provide anticorrosion properties when employed as lubricants for ferrous metals under conditions of high temperature (above 450° F.).

It is a principal object of this invention, therefore, to provide an improved grease based upon a perfluorinated polyalkylether fluid.

Another object of the invention is to provide a grease possessing antirust properties while lubricating ferrous metals under conditions of high humidity and mild temperatures.

A further object of the invention is to provide a grease having anticorrosion properties while lubricating ferrous metals in high temperature environments.

Other objects and advantages of the invention will become apparent to those skilled in the art upon consideration of the accompanying disclosure.

SUMMARY OF THE INVENTION

The present invention resides in the discovery that the addition of a small amount of certain fluorine-containing benzoxazoles to a fluorinated polyether base fluid and a thickener therefor provides a grease having unexpected and outstanding properties. Thus, the resulting grease composition inhibits rust formation when utilized as a lubricant for ferrous metals under mild temperature and high humidity conditions. Furthermore, the grease inhibits corrosion when used as a lubricant for ferrous metals under high temperature conditions.

In a more specific embodiment, the instant invention is concerned with a grease composition comprising (1) a major amount of a perfluorinated polyalkylether base fluid, (2) a minor amount of a thickener for the base fluid, and (3) a rust and corrosion inhibiting amount of a benzoxazole substituted in the 2-position with a perfluoroalkylether radical or a bis-benzoxazole in which the 2-position carbon atoms are attached to one another with a perfluoroalkylene or perfluoroalkyleneether radical.

More specifically, the grease composition consists essentially of (1) about 65 to 72 weight percent of base fluid, (2) about 26.5 to 34.5 weight percent thickener, and (3) about 0.5 to 1.5 weight percent of fluorine-containing benzoxazole, based upon a total of 100 weight percent. The fluorine-containing benzoxazoles can be used in larger amounts, but use of the larger quantities provides no added advantages. However, it is usually preferred to employ at least 1 weight percent of the fluorine-containing benzoxazole. It has been found that when less than 1 weight percent of this additive is utilized, the grease provides less protection to ferrous metals under conditions of high humidity and mild temperature or under conditions of high temperature. The thickener can be used in smaller or larger amounts with corresponding larger or smaller amounts of the base fluid to produce softer or thicker greases without degrading the properties of the greases.

In general, any suitable perfluorinated polyalkylether can be used as a base fluid in formulating a grease of this invention. However, it is preferred to employ base fluids having the following structural formulas:

$$C_3F_7O(\underset{\underset{CF_3}{|}}{C}FCF_2O)_nR', \qquad \text{(a)}$$

in which R′ is a perfluoroalkyl group containing 2 or 3 carbon atoms, n is an integer ranging from 5 to 50, inclusive, preferably from 10 to 40, inclusive, or (b) $X\text{-}O\text{-}(\text{-}C_3F_6\text{-}O\text{-})_P\text{-}(CF_2\text{-}O)_Q\text{-}(\text{-}C_2F_4\text{-}O\text{-})_R\text{-}Y$, in which $C_3F_6$ and $C_2F_4$ are perfluoroalkylene groups having the structure $$-CF_2-\underset{\underset{CF_3}{|}}{C}F-$$

and $-CF_2-CF_2-$, respectively, and the three different perfluoroalkylene units are randomly distributed along the chain, P, Q and R are average indices of composition and only P and/or R can be zero, the sum P+Q+R has a value of between 2 and 200, the ratio P/(Q+R) has a value of from 0 to 50, the ratio R/Q has a value of from 0 to 10, X and Y are terminal groups selected from the group consisting of $-CF_3$, $-C_2F_5$, $-C_3F_7$ and $$-\underset{\underset{CF_3}{|}}{C}F-O-CF_3$$

provided that both terminal groups X and Y are $-CF_3$ when both indices P and R are equal to zero, the terminal groups are the same or different from each other and are selected from the group consisting of $-CF_3$ and $C_2F_5$ when only index P is zero, and when P is different from zero, the two terminal groups are the same or different from each other and selected from the group consisting of $-CF_3$, $-C_2F_5$ and $-C_3F_7$, or one of the terminal groups may be $$-CF_3O-\underset{\underset{CF_3}{|}}{C}F-.$$

The value of n of compound (a) is usually such that the compound has a kinematic viscosity ranging from about 18 to 320 centistokes, preferably about 270 centistokes, at 100° F. The values of P, Q, and R of compound (b) are generally such that the compound has a kinematic viscosity ranging from about 4 to 520 centistokes, preferably about 90 centistokes, at 100° F.

Perfluorinated polyalkylethers corresponding to the aforementioned formulas are commercially available compounds that are discribed in the literature. For a detailed description of methods for preparing the compounds, reference may be made to U.S. Pat. No. 3,242,218 for compounds corresponding to formula (a) and to U.S. Pat. No. 3,665,041 for compounds corresponding to formula (b).

As a thickener, it is generally preferred to employ a fluorinated ethylene-propylene copolymer or polytetrafluoroethylene. The copolymer usually has a molecular weight of about 120,000 to 190,000, preferably about 140,000 to 160,000, and having a density of about 2.39 to 2.47 g/cc. The polytetrafluoroethylene usually has a molecular weight of about 2000 to 50,000, preferably about 10,000 to 50,000 and having a density of about 2.15 to 2.28 g/cc. These polymeric thickeners are well known materials that are described in the literature.

The fluorinated benzoxazole additives used in the grease compositions can be represented by the following structural formula:

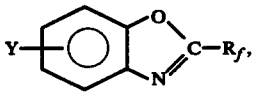

wherein $R_f$ is perfluoroalkyl, perfluoroalkylether, or

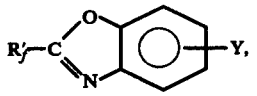

in which $R'_f$ is perfluoroalkylene or perfluoroalkyleneether, and Y is perfluoroalkyl, perfluoroalkylether or hydrogen.

The benzoxazole additives are prepared by reacting 2-aminophenol or a substituted 2-aminophenol with a perfluoroalkyl or perfluoroalkylether imidate ester or a perfluoroalkylene or perfluoroalkyleneether imidate ester. The reaction involved in preparing a compound with a single benzoxazole ring can be represented by the following equation:

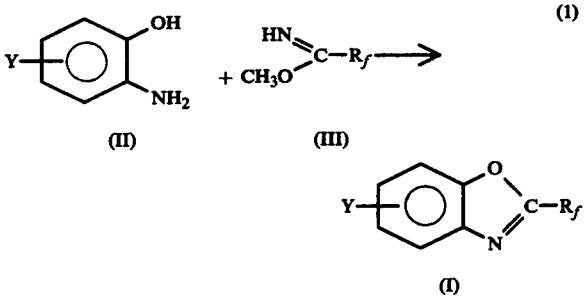

(1)

In synthesizing compounds containing two benzoxazole rings, the reaction shown by the following equation is conducted:

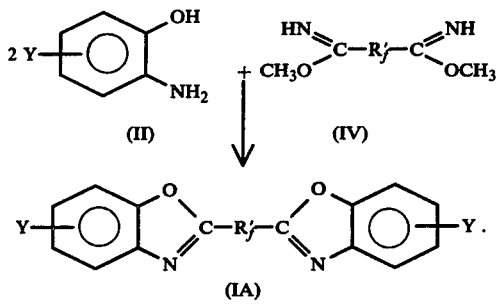

(2)

In the foregoing equations, $R_f$, $R'_f$ and Y are as defined hereinabove.

The reactions illustrated by equations (1) and (2) are conducted in the presence of glacial acetic acid, utilizing hexafluoroisopropanol as the reaction medium. The reaction temperature usually ranges from about 45 to 50° C. Depending upon the structure of the particular imidate ester utilized, the reaction time usually varies from about 10 minutes to 5 or 6 days. The sterically hindered imidate esters require longer periods of time as compared to the non-hindered imidate esters.

As seen from equations (1) and (2), the $R_f$ and $R'_f$ groups are derived from the imidate esters (III) and the diimidate esters (IV). These imidate esters are well known compounds that are described in the literature. For example, following the procedure described by H. C. Brown and C. R. Wetzel in Journal of Organic Chemistry, 30, 3724 (1965), a variety of imidate esters can be synthesized from a variety of fluorine-containing nitriles. Also, the synthesis of perfluoroalkyleneether diimidate esters is disclosed by one of us in U.S. Pat. No. 4,011,255. Examples of $R_f$ groups include perfluoroalkyls such as $C_xF_{2+1}$, where x is an integer from 1 to 10, inclusive; and perfluoroalkylethers such as $CF_2(OCF_2CF_2)_yOC_2F_5$, where y is zero or an integer from 1 to 10, inclusive; and $CF(CF_3)[OCF_2CF(CF_3)]_zOC_3F_7$, where z is zero or an integer from 1 to 10, inclusive. Examples of $R'_f$ groups include perfluoroalkylenes such as $(CF_2)_a$, where a is an integer from 1 to 10, inclusive; and perfluoroalkyleneethers such as $(CF_2)_4O(CF_2)_4O(CF_2)_4$; and $Z[CF(CF_3)CF_2O]_n(CF_2)_m[OCF_2CF(CF_3)]_nZ$, where each Z is $(CF_2)_4O$ or $CF(CF_3)OCF_2CF_2O$, n is an integer from 1 to 5, inclusive, and m is an integer from 2 to 10, inclusive.

Also, as seen from equations (1) and (2), the source of the Y groups is the substituted 2-aminophenol (II). [When Y is hydrogen, 2-aminophenol is used as the reactant with the imidate ester (III) or diimidate ester (IV).] As mentioned previously, Y can be a perfluoroalkyl or a perfluoroalkylether and examples of these radicals are set forth in the preceding paragraph.

The 2-aminophenols (II) can be synthesized by following a nitration and reduction procedure as described by R. C. Evers, Abstracts, 167th National Meeting of the American Chemical Society, Los Angeles, CA., April 1974, No. Poly. 087. The process for preparing the compound in which the Y group is in the para position can be represented by the following equation:

(3)

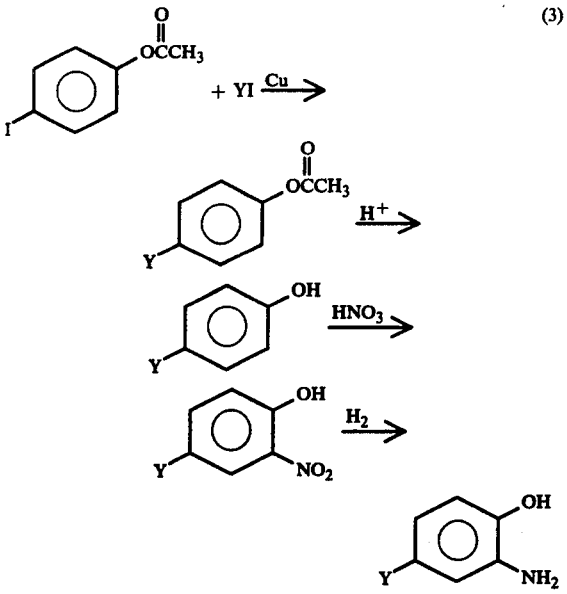

In the foregoing equation (3), Y is perfluoroalkyl or perfluoroalkylether. By utilizing m-$IC_6H_4OC(O)CH_3$ or o-$IC_6H_4OC(O)CH_3$ as a starting material, 2-aminophenols can be prepared in which the Y group is in the meta or ortho positions. It is often preferred to use 2-amino-4-perfluoropropylphenol as the substituted 2-aminophenol, i.e., where Y is $C_3F_7$.

A more complete description of the preparation of the fluorinated benzoxazoles is disclosed in our copending application Ser. No. 837,329, filed on Sept. 27, 1977. The disclosure of this application is incorporated herein by reference.

A more comprehensive understanding of the invention can be obtained by referring to the following illustrative examples which are not intended, however, to be unduly limitative of the invention.

EXAMPLE I

A series of runs was conducted in which grease compositions of this invention were formulated and tested. As a base fluid there was used a perfluorinated polyalkylether having the following formula:

$$C_3F_7O(\underset{\displaystyle CF_3}{\underset{|}{C}}FCF_2O)_nC_2F_5,$$

where n is an integer having a value such that the fluid has a kinematic viscosity of 270 centistokes at 100° F. The base fluid was Krytox 143AC fluid, a product of E. I. duPont de Nemours and Company, Wilmington, Del. The thickener employed was a fluorinated copolymer of ethylene and propylene having a molecular weight of about 150,000.

The benzoxazole additives used in the formulations had the following structural formula:

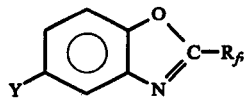

in which $R_f$ and Y were as indicated below in Table I.

TABLE I

| $R_f$ | Y |
|---|---|
| $C_8F_7$ | H |
| $C_3F_7O(\underset{\displaystyle CF_3}{\underset{\vert}{C}}FCF_2O)_4\underset{\displaystyle CF_3}{\underset{\vert}{C}}F$ | H |
| 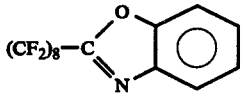 | $C_3F_7$ |
| 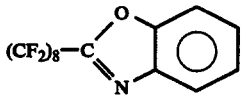 | H |
| 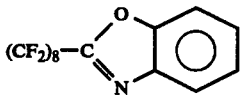 | $C_3F_7O(\underset{\displaystyle CF_3}{\underset{\vert}{C}}FCF_2O)_4\underset{\displaystyle CF_3}{\underset{\vert}{C}}F$ |
| 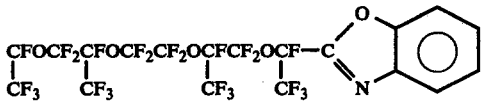 | H |
| 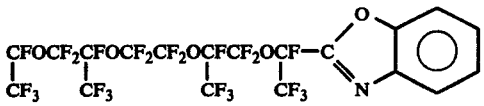 | $C_3F_7$ |
| 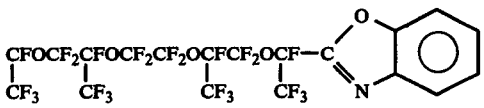 | $C_3F_7O(\underset{\displaystyle CF_3}{\underset{\vert}{C}}FCF_2O)_4\underset{\displaystyle CF_3}{\underset{\vert}{C}}F$ |
| $C_3F_7$ | $C_3F_7$ |

TABLE I-continued

| $R_f$ | Y |
|---|---|
| $C_3F_7O(CF\underset{\underset{CF_3}{\vert}}{C}F_2O)_4C\underset{\underset{CF_3}{\vert}}{F}$ | $C_3F_7O(CF\underset{\underset{CF_3}{\vert}}{C}F_2O)_4C\underset{\underset{CF_3}{\vert}}{F}$ |

In preparing the greases, the components were mixed and stirred until a uniform mixture was obtained. The amounts of base fluid used ranged from 65 to 72 weight percent while the amounts of thickener used ranged from 27 to 34 weight percent. Each grease composition contained 1.0 weight percent of the abovelisted fluorine-containing benzoxazole additives. Each mixture was further blended to a grease consistency by passing it two times through a 3-roll mill with the rollers set at an opening of 0.002" at about 77° F.

The various grease compositions were tested according to several standard test procedures. The penetration test was conducted in accordance with Federal Test Method Standard 791a, method 313.2. The rust preventive properties test was carried out in accordance with Method 4012 of the same standard. The high temperature corrosion was determined in accordance with the method set forth in Technical Documentary Report AFML-TR-69-290. The results of the tests are set forth hereinafter in Table II.

EXAMPLE II

A series of runs was conducted in which greases were prepared, utilizing, as described in Example I, the same thickener and benzoxazole additives and amounts thereof as well as the same amounts of a perfluorinated polyalkylether base fluid. However, the perfluorinated polyalkylether had the following structural formula:

$$X - O - (-C_3F_6-O-)_P(CF_2-O)_Q(-C_2F_4-O-)_R-Y$$

where X and Y are $CF_3$, $C_2F_5$, or $C_3F_7$, and P, Q, and R are integers such that the fluid has a kinematic viscosity of about 90 centistokes at 100° F.

The base fluid used was Fomblin Y fluid, a product of Montedison, S.p.A., Milan, Italy.

The greases were formulated and tested according to the procedures described in Example I. The results of the tests are also shown below in Table II.

EXAMPLE III

A series of runs was carried out in which greases were prepared, utilizing, as described in Example I, the same base fluid and benzoxazole additives and amounts thereof as well as the same amount of a thickener. However, the thickener used was polytetrafluoroethylene having a molecular weight of about 30,000.

The greases were formulated and tested according to the procedures described in Example I. The results of the tests are also set forth hereinafter in Table II.

EXAMPLE IV

A series of runs was carried out in which greases were prepared, utilizing as described in Example II the same base fluid and benzoxazole additives and amounts thereof as well as the same amount of thickener. However, the thickener used was polytetrafluoroethylene having a molecular weight of about 30,000.

The greases were formulated and tested according to the procedures described in Example I. The results of the test are shown hereinafter in Table II.

EXAMPLE V

Control runs were conducted in which greases were prepared, utilizing the base fluids and thickener of Examples I and II. The greases consisted of 71 weight percent base fluid and 29 weight percent thickener and did not contain any of the benzoxazole thickener.

The greases were formulated and tested according to the procedure described in Example I. The results of the tests are included below in Table II.

TABLE II

| | Greases of Example I | Greases of Example II | Greases of Example III | Greases of Example IV | Grease[1] based on 270 cs fluid, no additive | Grease[1] based on 90 cs fluid, no additive |
|---|---|---|---|---|---|---|
| Penetration, decimillimeters[2] | 301–307 | 302–307 | 311–317 | 312–317 | 298–300 | 310–310 |
| Rust Preventive[5] Properties | Pass[3] | Pass | Pass | Pass | Fail[4] | Fail |
| High Temperature[6] Corrosion 450° F, 72 hours | | | | | | |
| 52–100 93 100 steel | Pass | Pass | Pass | Pass | Fail | Fail |
| 440C steel | Pass | Pass | Pass | Pass | Fail | Fail |
| M-10 steel | Pass | Pass | Pass | Pass | Fail | Fail |
| M-50 steel | Pass | Pass | Pass | Pass | Fail | Fail |

[1]Control runs
[2]Range of penetration values of the various greases formulated in the examples, using FTMS 791a, Method 313.2. Pass
[3]Pass - No rusting or corrosion, a maximum of 3 spots allowed.
[4]Fail -More than 3 rust or corroded spots or pitting and etching.
[5]FTMS 79la, Method 4012.
[6]AFML-TR-69-290.

The data in the foregoing table demonstrate that the grease compositions of this invention do not cause ferrous metals to rust under mild temperature and high humidity conditions or to corrode under conditions of high temperature. The antirust and anticorrosion properties of the greases are directly attributable to the fluorine-containing benzoxazole additives. Thus, when the additive was omitted as in the control runs, rusting and corrosion of the ferrous metals occurred as a result of contact with greases based on perfluorinated polyalkylether fluids.

As will be evident to those skilled in the art, modifications of the present invention can be made in view of the foregoing disclosure without departing from the spirit and scope of the invention.

We claim:

1. A grease composition comprising a major amount of a perfluorinated polyalkylether base fluid, a minor amount of a fluorocarbon polymer thickening agent for the base fluid, and a rust and corrosion inhibiting amount of a fluorine-containing benzoxazole having the following structural formula:

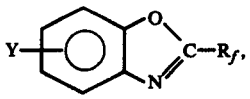

wherein $R_f$ is perfluoroalkyl, perfluoroalkylether, or

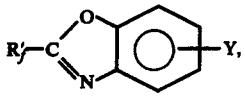

in which $R_f'$ is perfluoroalkylene or perfluoroalkyleneether and Y is perfluoroalkyl, perfluoroalkylether or hydrogen.

2. The grease composition according to claim 1 in which the perfluorinated polyalkylether base fluid is a compound selected from the group consisting of compounds having the following formulas:

$$C_3F_7O(\underset{\substack{|\\ CF_3}}{C}FCF_2O)_nR', \text{ and} \quad (a)$$

$$X-O-(-C_3F_6-O-)_P-(CF_2-O-)_Q-(-C_2F_4-O-)_R-Y \quad (b)$$

where R' is a perfluoroalkyl containing 2 or 3 carbon atoms, n is an integer ranging from 5 to 50, inclusive, P, Q and R are average indices of composition and only P and/or R can be zero, the sum P+Q+R has a value of between 2 and 200, the ratio P/(Q+R) has a value of from 0 to 50, the ratio R/Q has a value of from 0 to 10, X and Y are terminal groups selected from the group consisting of $-CF_3$, $-C_2F_5$, $-C_3F_7$ and $$-\underset{\substack{|\\ CF_3}}{C}F-O-CF_3$$

provided that both terminal groups X and Y are $-CF_3$ when both indices P and R are equal to zero, the terminal groups are the same or different from each other and are selected from the group consisting of $-CF_3$ and $-C_2F_5$ when only index P is zero, and when P is different from zero, the two terminal groups are the same or different from each other and selected from the group consisting of $-CF_3$, $-C_2F_5$ and $-C_3F_7$, or one of the terminal groups may be $$CF_3-O-\underset{\substack{|\\ CF_3}}{C}F-.$$

3. The grease composition according to claim 2 in which the thickening agent is a fluorinated ethylene-propylene copolymer or polytetrafluoroethylene.

4. The grease composition according to claim 3 which comprises about 65 to 72 weight percent of the base fluid, about 26.5 to 34.5 weight percent of the thickening agent, and about 0.5 to 1.5 weight percent of the fluorine-containing benzoxazole, based upon a total of 100 weight percent.

5. The grease composition according to claim 4 in which $R_f$ is perfluoroalkylether and Y is hydrogen.

6. The grease composition according to claim 5 in which the perfluoroalkylether is $$C_3F_7O(\underset{\substack{|\\ CF_3}}{C}FCF_2O)_4\underset{\substack{|\\ CF_3}}{C}F.$$

7. The grease composition according to claim 4 in which $R_f$ is perfluoroalkyl and Y is hydrogen.

8. The grease composition according to claim 7 in which the perfluoroalkyl is $C_8F_{17}$.

9. The grease composition according to claim 4 in which $R_f$ and Y are perfluoroalkyls.

10. The grease composition according to claim 9 in which each perfluoroalkyl is $C_3F_7$.

11. The grease composition according to claim 4 in which $R_f$ is

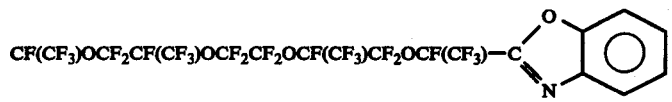

and Y is H.

12. The grease composition according to claim 4 in which $R_f$ is

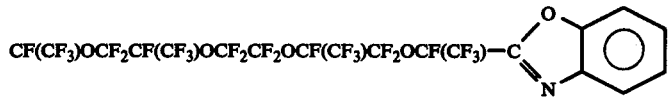

and Y is $C_3F_7$.

* * * * *